United States Patent [19]

Garab

[11] 4,073,414

[45] Feb. 14, 1978

[54] AUTO CRUCIBLE FOR METERING AND TRANSFERRING LIQUID METALS

[75] Inventor: H. Gary Garab, Rensselaer, N.Y.

[73] Assignee: Albany International Corporation, Albany, N.Y.

[21] Appl. No.: 712,938

[22] Filed: Aug. 9, 1976

[51] Int. Cl.[2] ..... B22D 39/00; B22D 41/10

[52] U.S. Cl. ..... 222/602; 222/149

[58] Field of Search ..... 222/149, 504, 559, 568, 222/602, 629, 591, 597; 164/336

[56] References Cited

U.S. PATENT DOCUMENTS

| | | | |
|---|---|---|---|
| 2,614,885 | 10/1952 | Roell et al. | 222/149 X |
| 2,640,630 | 6/1953 | Genco | 222/559 X |
| 3,070,126 | 12/1962 | Schneider | 222/591 X |
| 3,157,923 | 11/1964 | Hodler | 222/602 X |
| 3,366,288 | 1/1968 | Goldschein | 222/504 |
| 3,702,748 | 11/1972 | Storb et al. | 222/602 X |

*Primary Examiner*—Robert B. Reeves
*Assistant Examiner*—David A. Scherbel
*Attorney, Agent, or Firm*—Kane, Dalsimer, Kane, Sullivan and Kurucz

[57] ABSTRACT

A device for metering and transferring liquid non-ferrous metals. A hollow sleeve is mounted on a supporting structure and a pouring spout is on one end of the hollow sleeve. An orifice is in the pouring spout communicating with the interior of the sleeve. A stopper rod extends into the sleeve and is shiftable between a position seating on the pouring spout and sealing the orifice therein and a position removed from the pouring spout to permit liquid metal to flow into and out of the hollow sleeve. The parts are made of cast iron and the stopper rod has a tungsten carbide tip for passage through the orifice during the sealing and unsealing thereof to clean the orifice and to prevent foreign matter from collecting in the orifice.

15 Claims, 4 Drawing Figures

FIG. 3
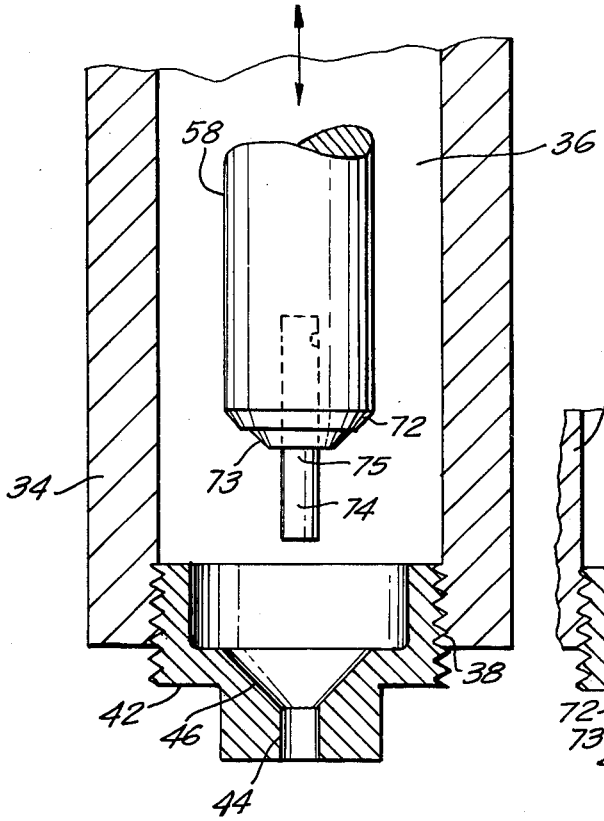
FIG. 4
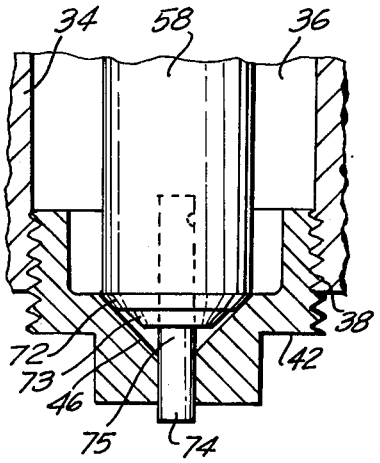
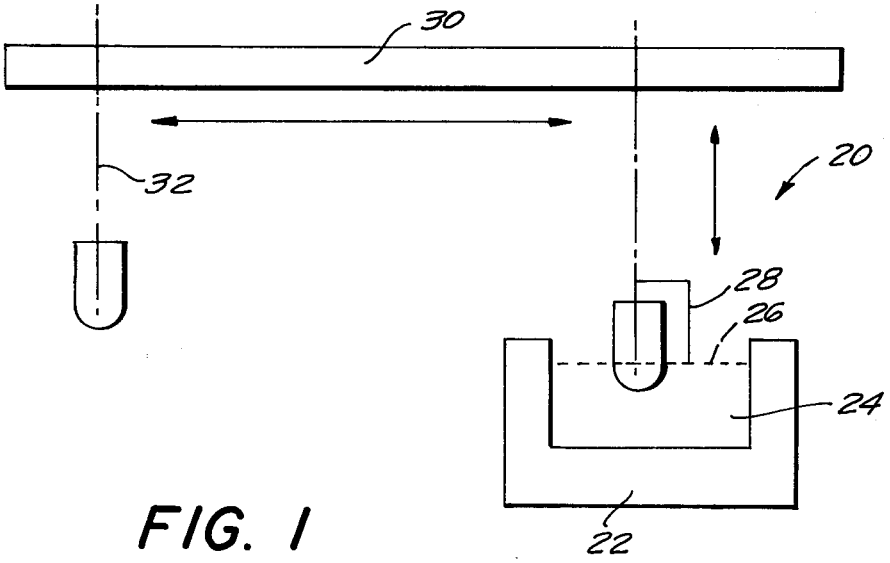
FIG. 1

AUTO CRUCIBLE FOR METERING AND TRANSFERRING LIQUID METALS

BACKGROUND OF THE INVENTION

In dealing with the transferring of liquid metals from a furnace by means of a crucible or ladle, there are a number of problems present in the art today. For example, when dealing with copper alloy metals, there is no other presently known automatic ladle or crucible which does not leak. Also, there is a constant problem of dross interference when the ladle is used repeatedly. Dross, otherwise known as slag forms along the inner walls, in the pouring spout of the ladle and, in particular, in the orifice of the pouring spout thereby disturbing the accuracy of the ladle when it is used repeatedly. This dross formation occurs by oxidation and the accummulation of impurities in the main body of the ladle and in the orifice during removal and introduction of the ladle into and out of the furnace. The liquid metal within the furnace contains a layer of slag or dross on its upper surface which collects in and about the entrance of the orifice thereby destroying accuracy and causing interference with operation of the ladle. Also, with dross accummulating in the orifice when the shot of metal within the ladle is discharged, dross can be entrained with the shot causing dross discharge which is also an obvious disadvantage in known ladle and crucibles. The environment which is of particular concern is in casting operations where precise shot sizes of metal are to be delivered to a shotwell or mold cavity.

It should also be kept in mind that in addition to the problem of dross build-up in the orifice area, the accuracy is also affected in those ladles which do not have proper seals to the pouring spout orifice. Repeated dripping detracts from the accuracy of the shot which is to be delivered to mold cavity. In certain instances, it is been known that the manufacturer would not guarantee operation, for example, with molten brass.

In general, there is a need for an automatic metering ladle which provides clean liquid metal each time for non-ferrous metals. The device should minimize the dripping of metal, reduce and provide means to correct for wear and errosion of the ladle parts and maintain the cleanliness of the poured metal as it is passed into the mold from the crucible or ladle. Additionally, automation is of importance and an automated crucible or ladle for accomplishing the above results would be of great advantage, particularly in the fact that it would eliminate the need for an operator to manually pour the metal.

SUMMARY OF THE INVENTION

With the above background in mind, it is among the primary objectives of the present invention to provide an automatic crucible or ladle which can be used with non-ferrous metals including copper alloy metals with no danger of leakage. The ladle is designed to provide for repeated accuracy of metering, eliminate dross interference with the operation of the ladle, provide for substantial less dross formation in the ladle than previously experienced with other structures and, provide for less dross discharge with the shot as entrainment in the metal which singularly or in combination are among the defects of known ladles.

In general, among the ways in which the present structure prevents leakage is by utilization of cast iron components for the device and since the cast iron tends to anneal at the operating temperature for liquid copper alloy metals, the interconnected components will more effectively seal with one another in the areas of contact. Leakage is also prevented by providing a rotational movement between the parts which combine to close the orifice in the ladle. Furthermore, means are provided to exert a seating pressure on the rod, for example 50 psi provide a more positive seal between the stopper rod and the pouring spout. The seal is also assisted by providing chamfered seating areas to the shiftable components which provide for opening and closing of the pouring spout. Furthermore, the structure of the device is of minimal components and simple and easy to disassemble so that the ladle components can be removed and replaced when they become worn or corroded. This is true for parts such as those forming the chamfered areas sealing the orifice in the pouring spout.

Furthermore, the device is designed for repeated metering accuracy which is obtained by maintaining a constant size orifice in the spout. Orifice size change may be the result of erosion, wear between parts in contact with the orifice, or due to dross build up on these same parts. Wear is controlled by providing a somewhat larger diameter to the pouring orifice in the spout than the diameter of a shiftable component part extending therethrough in the form of a stopper rod tip. It is also contemplated that the rod tip can be made of tungsten carbide which resists wear and corrosion. Furthermore, build up on the parts such as the stopper rod and spout which are movable with respect to one another is controlled by the rotary motion of the tip, upon each lowering of the rod and also by the above mentioned diameter differentials which allow drainage below the chamfered seal at the end of the orifice. In this manner the liquid metal below the seal can drip back into the pot upon removal of the ladle.

The lack of dross interference in the orifice during the ladle operation is also explained by the above discussed rotational action and the clearances provided at the orifice location.

A further decrease in the dross formation in the ladle is accomplished by the rapidity of the operation wherein air, which is necessary to form the dross, is forced, by the hot gases emanating from the molten metal, through an aperture at the top of the ladle and prevented from returning due to the rapid cycle. It should also be noted that the present structure provides for decreased dross entrainment in the metal by providing the rod tip with sufficient length to extend slightly beyond the spout when the ladle is lowered into the pot thus preventing a pickup of dross from the top of the metal. The rod is lifted only after the spout is below the dross level and closed again before the ladle is removed from the pot. Since dross forms in the presence of air, the dross within the pot or furnace is located on the top exposed surface of the molten metal only.

An automatic metering ladle is provided which provides clean liquid metal each time. It is adapted for use with non-ferrous metals. The structure is designed to minimize dripping of metal, reduce and provide means for correction of wear or erosion of the ladle lining, maintain cleanliness of poured metal and additionally, to eliminate the need for an operator to manually pour the metal. The overall structure provides for an hydraulically actuated cylinder arrangement to traverse the ladle vertically and horizontally between the furnace containing the molten metal and the pour-off station. Naturally other means of linear actuation are also contemplated such as air cylinders, ball screws, electric linear actuators and the like. Timers determine the interval during which the ladle remains in the molten metal to provide a given column pick-up time required for pouring of the shot.

In the depicted embodiment, the ladle consists of a cast iron sleeve with a cast iron pouring spout. The pouring spout is threaded into the sleeve. A stopper rod, also of cast iron seats over the pouring spout to close it off. When the rod is lifted, the metal pours out. A tungsten carbide tip at the end of the stopper rod cleans out the hole with a vertical and rotary motion. An appropriate actuator is supplied to provide this motion each time the stopper is lowered. If desired, it is possible to also provide a rotary motion when the stopper is raised. The tip keeps slag or dross out of the orifice and also extends beyond the orifice slightly when the rod is down. This keeps foreign matter out of the orifice when the ladle is lowered into the molten metal. An aperture in the top of the ladle allows gases to escape at high velocity and the rapidity of the operation cycle prevents new air from coming in.

At the elevated temperatures of operation, for example temperatures of 1700° F–2000° F for brass, the cast iron is at its annealed or soft state. This helps get a good seal between the stopper rod and the pouring spout each time. There is a slight pressure provided which could be of a hydraulic nature or air or spring on the stopper rod whenever it is down on the seat.

In summary, a device is provided for metering and transferring liquid metals. It includes a supporting structure and a hollow sleeve mounted on the supporting structure. The sleeve is opened at both ends and a pouring spout is on one end of the sleeve and has an orifice therethrough communicating with the hollow interior of the sleeve. A stopper rod extends into the sleeve from its other end to be shiftable between a position seating on the pouring spout thus sealing the orifice therein and a position removed from the pouring spout to permit liquid metal to flow into and out of the hollow sleeve. Means are provided for automatically shifting the stopper rod between positions and means are also provided for cleaning the orifice and from preventing foreign matter from collecting in the orifice.

With the above objectives in mind, reference is had to the attached drawings.

BRIEF DESCRIPTION OF THE DRAWINGS

In The Drawings

FIG. 1 is a schematic representation of the device of the invention shown as part of casting apparatus;

FIG. 3 is an enlarged partially sectional view of the device with the parts in position for metal to flow into and out of the orifice in the pouring spout; and FIG. 4 is an enlarged partially sectional view of the device with the parts in position closing the orifice in the pouring spout.

DESCRIPTION OF THE PREFERRED EMBODIMENTS

Figure 2:
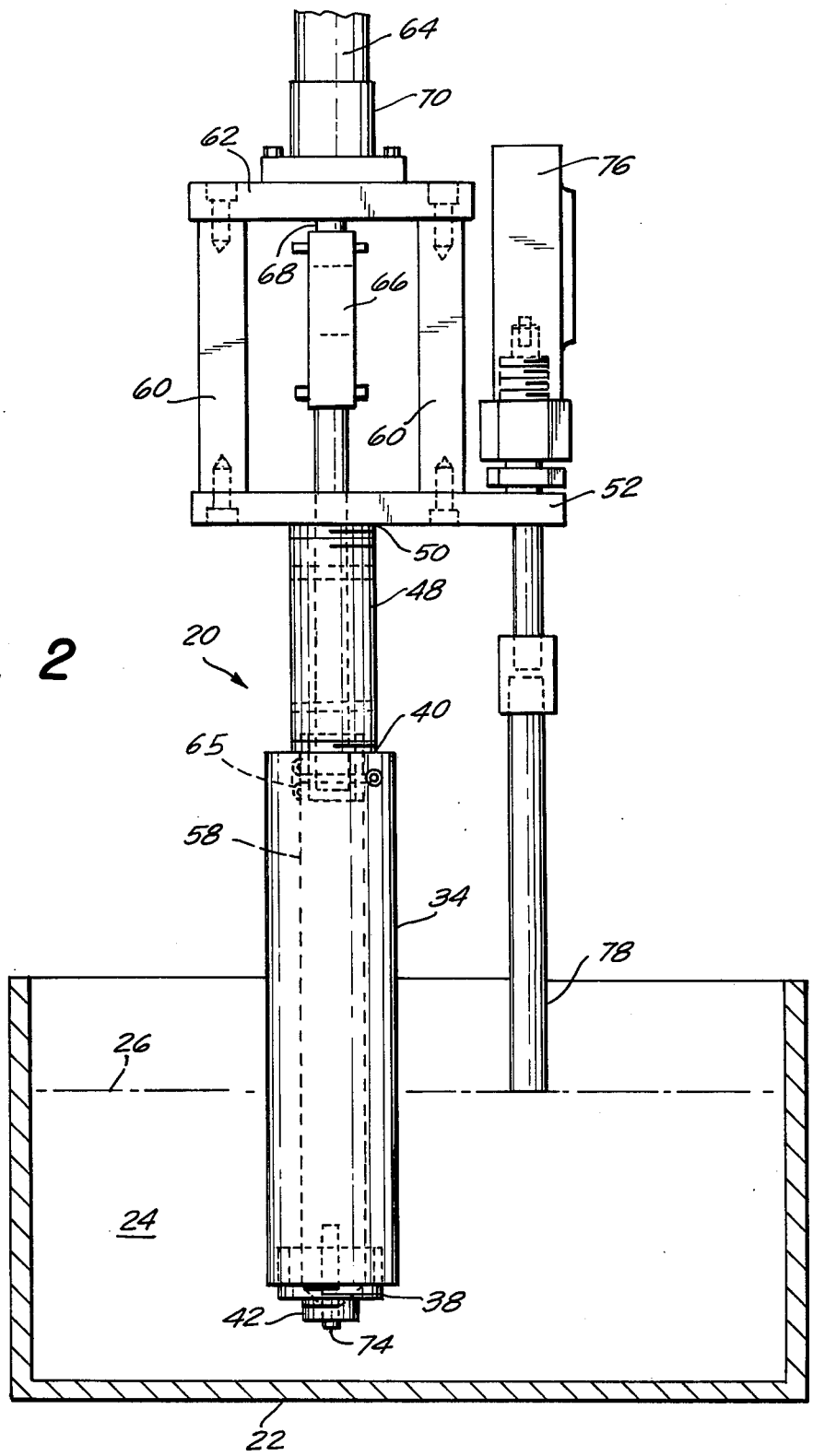
FIG. 2 is an enlarged partially sectional elevation view of the device of the invention shown positioned in a furnace containing molten metal.

The ladle or crucible device 20, as shown in FIG. 1, is designed particularly for use in a metal casting apparatus of a conventional nature. An appropriate furnace 22 is provided with a central chamber to hold molten metal which has been heated to liquid form. In dealing with many types of metals such as copper alloys and brass, a slag layer 26 forms on the upper surface of the metal 24 where it meets with oxygen from the air.

The crucible or ladle device 20 is reciprocally movable into and out of the open top of the furnace and accordingly into and out of the molten metal 24. A probe 28 is used to control the depth of the crucible within the furnace.

The crucible is connected to an over-head guideway and support structure 30 which serves to guide and support the crucible after it has been removed from the furnace and delivered to a further work station such as pouring station 32 whereupon the metal shot contained in the ladle is released into a mold cavity or a shot well.

The ladle of the depicted embodiment is formed predominently of cast iron parts, however, it is visioned that materials of a similar nature can be employed in substitution therefor.

A cast iron sleeve 34 is provided and is hollow to form an inner shot chamber 36. The sleeve has an open bottom end 38 and an open top end 40. Both of the open ends have a threaded inner surface for coupling to other components. At bottom end 38 a pouring spout 42 with a threaded outer surface is coupled with the sleeve to close off the bottom open end. A central orifice 44 is provided in the pouring spout for passage of the molten metal therethrough into an outer chamber 36 in the sleeve. The upper end 46 of orifice 44 is chamfered or beveled to facilitate the sealing process in opening and closing the orifice. Pouring spout 42 is also constructed of cast iron.

Threadedly interengaged with the upper inner surface of sleeve 34 is a connecting nipple 48 which has a threaded lower end to couple with the sleeve and also has a threaded upper end for threaded interengagement with a threaded aperture 50 in a horizontal supporting plate 52. The supporting plate is mounted to a pair of opposing upright supports 60 which are interconnected with a top plate 62. The top plate is in connection with the main top supporting structure 64 which extends into conventional interconnection with the guideway 30.

Stopper rod 58 is coupled at its upper end by a conventional coupler 66 to the drive shaft 68 of a drive means 70. The drive means 70 is of a conventional nature and is designed to vertically reciprocate stopper rod 58 and to rotate the stopper rod a predetermined amount of turn after seating. A turn of approximately 90 degrees has been found to work effectively.

A conventional main drive mechanism is utilized to lift the entire device 20 and the interconnected supporting structure described above upward and to lower it accordingly in connection with furnace 22.

Stopper rod 58, which may be segmented by optional coupling 65 to provide course height adjustment and facilitate the removal and replacement of the tip end is also constructed of cast iron and has a beveled or chamfered surface 72 connected to a beveled transition segment 73 adjacent its elongated tip 74. The segment 73 is circumfrencially smaller then the laterally adjacent areas of seat 46 which allows a relief area therebetween. The tip 74 can be of a variety of different materials and it has been found effective to form the tip of tungsten carbide material.

When the rod 58 is in the full downwardly extended position its chamfered lower end 72 mates with a portion of the chamfered portion 46 of orifice 44 in the pouring spout to form a sealing interengagement therewith and close the orifice. The total length of transition segment 73 and tip 74 is slightly longer than the remaining portion of orifice 44 and therefore at the same time extends beyond the bottom end of the pouring spout. Additionally, tip 74 is of slightly less diameter than orifice 44 providing a slight clearance therebetween.

A probe support 76 is aligned with an upright support 60 and is interconnected therewith by a laterally extending arm 78. This spaces the probe support 76 laterally from the ladle and permits the vertical extension of a probe 78 downward to the surface of the molten metal. Probe 78, a conventional conductor, is utilized to determine electrically its contact with the molten metal and consequently regulate the depth of the immersion of the ladle into the molten liquid.

As stated above, sleeve 34, pouring spout 42, and stopper rod 58 with the exception of tip 74 are constructed of cast iron which has been found to operate effectively for the ladle. Nipple 48 used primarily to reduce heat transfer by conduction can be constructed of stainless steel or any conventional substitute therefro and the remaining supporting structure can be of a conventional metal material such as steel.

In use, the components of the ladle are in the position as depicted in FIG. 2, initially. Tip 74 is housed in pouring spout orifice 44 and a sealing interengagement exists between the beveled or chamfered portions 72 and 46. The ladle is guided into alignment with the furnace 22 and the main drive structure is actuated to lower the ladle into the molten metal 24 in the furnace 22 until probe 78 makes contact with the metal and thereby signals for the cessation of the vertical downward movement of the ladle. As the ladle enters the molten metal it passes through the layer of dross or slag on the top surface thereof. The presence of the tungsten carbide tip extending beyond the lower end of orifice 44 substantially prevents entry of the slag or dross into the orifice thereby protecting the opening into the chamber 36.

When the ladle is at the submerged downward filling position, the actuator mechanism 70 is automatically activated to lift stopper rod 58 upward. The molten metal 24 then passes through orifice 44 and into chamber 36 to the predetermined height at which time the stopper rod 58 is lowered to close orifice 44. Since the pouring spout is below the slag level there is no introduction of slag or dross into the chamber. In this manner, the desired shot of molten metal is contained within the ladle.

Actuator 70 is then activated to drive the stopper rod 58 downward and then rotate the stopper rod after seating into its initial position. The rotating action helps effect the seal between chamfered surfaces 72 and 46. This seal is also assisted by the presence of the chamfered surfaces and by the fact that the cast iron will be in its annealed or soft state. This will occur since the molten metal will be at an elevated temperature particularly if copper alloys or similar metals are being handled. For example, brass would be at temperatures of 1700°–2000° F.

A hydraulic pump can also be provided as part of the drive mechanism 70 for the stopper rod to exert a slight pressure on the rod in the downward direction and further effect a positive seal between the chamfered surfaces and prevent any leakage of metal from the chamber 36.

The main drive mechanism is then activated to lift the ladle and supporting structure out of the furnace. As this occurs, the presence of pin 74 prevents collection of dross 26 within orifice 44 in the same manner as it prevented such collection in the downward movement in the furance. Additionally, there is slight clearance between pin 74 and orifice 44 so that any excess metal can drip out of the bottom of the pouring spout as the ladle is lifted.

Once the ladle is removed from the furnace 22, the main drive mechanism then traverses the ladle and supporting structure to the pouring station 32 at which time the stopper rod will be again activated by mechanism 70 and will be vertically lifted to open orifice 44 and permit the shot of metal within chamber 36 to pour through orifice 44 into a slot well or mold. In this manner, accuracy of the orifice opening 44 is maintained throughout an extended period of time. Furthermore, the chance of dross being entrained in the molten metal shot exiting from chamber 36 is minimized and in most cases completely eliminated. Consequently, a pure charge of molten metal is introduced into the mold.

The procedure is then repeated with the main drive mechanism which is, as described above, a hydraulically actuated cylinder that traverses the ladle back to the furnace for a repeat procedure. Appropriate timing mechanisms (not shown) can be provided to determine the time of each step in the procedure.

Central opening 56 is provided on the top of the ladle to permit gases to escape at high velocity including the forcing of air out through the upper end of the ladle. At the same time, the high velocity movement of gases out of the ladle will serve to substantially deter and in most cases prevent air from reentering through the top of the ladle and acting with the molten metal iron components. These components, pouring spout 42, stopper rod 58, and sleeve 34 tend to anneal at the operating temperature for liquid copper alloy metals thereby providing a more effective seal and preventing leakage. Additional safe guards against leakage are also provided by the rotational movement in a seating chamfered surface 72 on chamfered surface 74, by providing a seating pressure on stopper rod 58, for example 50 psi, by providing the chamfered seating areas at the point of seal, and by providing means to easily remove and replace the rod and spout whenever the chamfered areas may become worn or corroded.

Repeated metering accuracy is obtained by maintaining a constant size orifice in the spout. Orifice size change may be the result of wear between rod tip 74 and spout 42 or metal and dross build up on the same parts. Wear is controlled by providing a somewhat larger diameter to orifice 44 in the spout 42 than the diameter of rod tip 74. This is also accomplished by making the rod tip of a material such as tungsten carbide which resits wear and corrosion. The rotary motion of tip 74 also guards against build up upon each lowering of the rod. Further, the diameter differential between the tip 74 and orifice 44 permits drainage below the chamfered seal of the liquid metal back into the furnace upon removal of ladle 20.

Decreased dross formation in the ladle is accomplished by air, which is necessary to form dross, being forced, by the hot gases emanating from the molten metal, through the clearance between opening 56 and rod 58. Return of air is primarily prevented by the rapid cycle of operation.

Decreased dross entrainment in the liquid metal results from providing the tip 74 with sufficient length to extend the bottom end of spout 42 when the ladle is lowered into the furnace 22 thus preventing a pick-up of dross 26 from the top of the liquid metal 24. Rod 58 is lifted only after spout 42 is below the dross level and closed again before the ladle 20 is removed from the furance 22.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A device for metering and transferring liquid metals comprising:

a support structure;

a hollow sleeve on the supporting structure and an opening at both ends;

a pouring spout on one end and having an orifice therethrough communicating with the hollow interior of the sleeve;

a stopper rod extending into the sleeve from the other end thereof to be shiftable between a position seating on the pouring spout and sealing the orifice therein and a position removed from the pouring spout to permit liquid metal to flow into and out of the hollow sleeve, the stopper rod and the pouring spout having mating surfaces thereon to facilitate sealing engagement therebetween when the stopper rod is in the seating position to prevent leakage;

means for shifting the stopper rod between positions the means for shifting the stopper rod between positions including axial drive means and rotary drive means to permit the stopper rod to be rotated with respect to the pouring spout and sleeve and to be axially shifted with respect to the pouring spout and sleeve and operating so that when the stopper rod is directed into mating engagement with the pouring spout it will be both axially and rotatably brought into mating engagement thereby facilitating sealing of the stopper rod and pouring spout to prevent leakage;

means for transferring the device into and out of a container of liquid metal with the stopper rod being in the seated position on the pouring spout during insertion into the liquid metal to facilitate prevention of accumulation of undesirable materials within the hollow sleeve during the insertion into the liquid metal to the desired depth;

means for cleaning the orifice and for preventing undesirable materials from collecting in the orifice including the end of the stopper rod adjacent the pouring spout having a small diameter tip portion extending therefrom of a predetermind length so that when the stopper rod is seated in sealing position on the pouring spout the tip will extend through the orifice in the pouring spout thereby guarding against the accumulation of foreign matter in the orifice while the device is being transferred into a container of liquid metal, and when the stopper rod is removed from the seating position on the pouring spout the tip will be removed therefrom to permit liquid metal to freely flow through the orifice in the pouring spout and the tip acting to remove any collection of undesirable material from the orifice upon reinsertion therein as it is rotated and axially moved with the stopper rod as the stopper rod is reseated on the pouring spout.

2. The invention in accordance with claim 1 wherein means are provided for transferring the device from the location of a furnace containing liquid metal to a pouring station whereupon liquid metal within the sleeve can be poured upon shifting of the rod to the position removed from the pouring

3. The invention in accordance with claim 1 wherein the sleeve, the pouring spout, and the stopper rod are constructed of cast iron material.

4. The invention in accordance with claim 1 wherein timing means is provided to determine the time at which the stopper rod will be positioned in each of the two positions with respect to the pouring spout.

5. The invention in accordance with claim 1 wherein the pouring spout has a threaded outer surface and one end of the sleeve has a threaded inner surface thereby facilitating the threaded interengagement between the pouring spout and one end of the hollow sleeve.

6. The invention in accordance with claim 1 wherein the tip is formed of tungsten carbon material and is connected to the end of the stopper rod.

7. The invention in accordance with claim 1 wherein the mating surfaces between the stopper rod and the pouring spout are beveled to facilitate seating engagement therebetween.

8. The invention in accordance with claim 1 wherein the tip has a lesser outer diameter than the diameter of the orifice in the pouring spout to alleviate the danger of interference therebetween and facilitate the movement of the tip into and out of the orifice.

9. The invention in accordance with claim 1 wherein the pouring spout is removably mounted on one end of the sleeve and the stopper rod is movably mounted on the support structure.

10. The invention in accordance with claim 1 wherein pressure means is provided to produce a slight pressure on the stopper rod when it is seated with respect to the pouring spout thereby providing a more positive seating interengagement therebetween.

11. The invention in accordance with claim 1 wherein the end of the sleeve distal from the end connected to the pouring spout has a threaded inner surface and the supporting structure adjacent thereto has a threaded surface, a tubular pipe nipple having a passageway therethrough and threaded outer surface portions at both ends with the nipple being threadedly interengaged with the threaded surface on the supporting structure and the other end of the nipple being threadedly interengaged with the adjacent threaded end portion of the sleeve in position for passage of the stopper rod through the nipple and thereby interconnecting the sleeve to the supporting structure.

12. The invention in accordance with claim 1 wherein a probe is mounted on the supporting structure and has a predetermined length to extend to the surface of the molten metal and determine the depth of immersion of the ladle into molten metal contained in the furnace.

13. The invention in accordance with claim 1 wherein the stopper rod is rotated about approximately a 90° turn.

14. The invention in accordance with claim 1 wherein the sleeve, the pouring spout and the stopper rod are of metal material and are operated at a temperature at which the metal is annealed when liquid metal is handled by the device.

15. The invention in accordance with claim 1 wherein the sleeve, the pouring spout, and the stopper rod are of metal material and the device is operated in handling liquid metals at a temperature at which the sleeve, the pouring spout, and the stopper rod are annealed, the means for shifting the stopper rod between positions including axial drive means and rotary drive means to permit the stopper rod to be rotated with respect to the pouring spout and sleeve and to be axially shifted with respect to the pouring spout and sleeve, and pressure means being provided to produce a slight pressure on the stopper rod when it is seated with respect to the pouring spout so that the combined annealed elements being rotated and subjected to pressure provides a more positive seating interengagement.

* * * * *